US006328134B1

(12) United States Patent
Hikita

(10) Patent No.: US 6,328,134 B1
(45) Date of Patent: Dec. 11, 2001

(54) GROUP MANAGEMENT AND CONTROL SYSTEM FOR ELEVATORS

(75) Inventor: Shiro Hikita, Tokyo (JP)

(73) Assignee: Mitsubishi Denki Kabushiki Kaisha, Toyko (JP)

( * ) Notice: Subject to any disclaimer, the term of this patent is extended or adjusted under 35 U.S.C. 154(b) by 0 days.

(21) Appl. No.: 09/671,651

(22) Filed: Sep. 28, 2000

(30) Foreign Application Priority Data

Mar. 30, 2000 (JP) ..... 12-094376

(51) Int. Cl.[7] ..... B66B 1/36
(52) U.S. Cl. ..... 187/382; 187/393
(58) Field of Search ..... 187/380, 382, 187/384, 386, 387, 388, 391, 393

(56) References Cited

U.S. PATENT DOCUMENTS

| | | | | |
|---|---|---|---|---|
| 4,166,518 | * | 9/1979 | Nakazato et al. | 187/29 R |
| 4,531,616 | * | 7/1985 | Uetani et al. | 187/29 R |
| 5,241,141 | | 8/1993 | Cominelli . | |
| 5,290,976 | | 3/1994 | Bahjat et al. . | |
| 5,637,841 | * | 6/1997 | Dugan et al. | 187/294 |
| 5,663,538 | * | 9/1997 | Sakita | 187/382 |
| 5,786,550 | * | 7/1998 | Thangavelu | 187/386 |

FOREIGN PATENT DOCUMENTS

| | | |
|---|---|---|
| 50-48645 | 4/1975 | (JP) . |
| 57-184078 | 11/1982 | (JP) . |
| 61-263579 | 11/1986 | (JP) . |
| 4-226283 | 8/1992 | (JP) . |
| 5-147838 | 6/1993 | (JP) . |
| 5-213543 | 8/1993 | (JP) . |
| 9-267977 | 10/1997 | (JP) . |

* cited by examiner

*Primary Examiner*—Jonathan Salata
(74) *Attorney, Agent, or Firm*—Leydig, Voit & Mayer, Ltd.

(57) ABSTRACT

A group management and control system for elevators can ensure high transport efficiency while an ordinary hoist and motor are employed, and can perform appropriate group management and control without causing a wrong arrival preannouncement even when a plurality of elevators travel at different accelerations. The group management and control system for elevators includes a load detecting unit for detecting a load in each elevator cage; an acceleration setting unit for setting an acceleration and a jerk rate of each elevator to upper limit values in accordance with a detected result of the in-cage load from the load detecting unit when the in-cage load is within a certain range from a balanced state; an estimation processing unit for computing estimated time at which each elevator will arrive each floor on the basis of the detected result of the in-cage load and the set acceleration; an assignment control unit for assigning an appropriate elevator in response to a call issued from an elevator hall in consideration of an estimation processing result; and an operation control unit for controlling operation of each elevator in accordance with an assignment result.

20 Claims, 5 Drawing Sheets

GROUP MANAGEMENT AND CONTROL SYSTEM FOR ELEVATORS

BACKGROUND OF THE INVENTION

1. Field of the Invention

The present invention relates to a group management and control system for elevators.

2. Description of the Related Art

In an ordinary elevator system, acceleration and jerk rate of each elevator are generally set in advance and not changed. However, Japanese Unexamined Patent Application Publication Nos. 4-226283 and 9-267977, for example, disclose a system including means for speeding up a floor-to-floor moving time of each elevator and means for and slowing down the same, one of these means being selected depending on a traffic state of the elevator. In those Publications, the acceleration is increased as practical means for speeding up the floor-to-floor moving time.

Also, Japanese Unexamined Patent Application Publication No. 61-263579 discloses a system for increasing acceleration in a time period when the number of passengers reaches a peak, thereby improving the transport efficiency.

In the related art, however, the load in a cage has not been taken into account as a condition for changing the acceleration and the jerk rate. This implies the necessity of preparing a hoist, a motor, etc. which are durable against a high acceleration, for example, even in a fully occupied condition, thus often resulting in a remarkable increase in the cost of an elevator system.

Further, many recent elevator systems employ a technique for preannouncing, to persons who are going to take the elevator, through a responding unit as soon as the person pushes a call button in an elevator hall, by using a hall lantern. Such a technique is based on the estimated time at which each elevator will arrive at each floor. Where a plurality of elevators are installed, however, there is a problem that, if the elevators travel at different accelerations from each other, a wrong arrival preannouncement is more likely to occur due to an error in estimation.

SUMMARY OF THE INVENTION

With the view of solving the problems set forth above, an object of the present invention is to provide a group management and control system for elevators, which can ensure high transport efficiency while an ordinary hoist, a motor, etc. are employed, and which can perform appropriate group management and control without causing a wrong arrival preannouncement even when a plurality of elevators travel at different accelerations from each other.

To achieve the above object, the present invention is constructed as follows.

(1) In a group management and control system for elevators which manages and controls a plurality of elevators as a group, the system comprises a load detecting unit for detecting a load in each elevator cage; an acceleration setting unit for setting an acceleration and a jerk rate of each elevator to predetermined upper limit values in accordance with a detected result of the in-cage load from the load detecting unit when the in-cage load is within a certain range from a balanced state; an estimation processing unit for computing estimated time at which each elevator will arrive each floor on the basis of the detected result of the in-cage load and the set acceleration; an assignment control unit for assigning an appropriate elevator in response to a call issued from an elevator hall in consideration of an estimation processing result; and an operation control unit for controlling operation of each elevator in accordance with an assignment result.

(2) In the group management and control system for elevators of above (1), preferably, the system further comprises a traffic flow recognizing unit for recognizing what traffic flow occurs in a facility in which the elevators are installed, and the estimation processing unit computes the estimated time at which each elevator will arrive each floor and the estimated in-cage load at each floor on the basis of the detected result of the in-cage load, the set acceleration and the recognized traffic flow.

(3) In the group management and control system for elevators of above (1) or (2), preferably, the estimation processing unit computes the estimated time at which each elevator will arrive each floor using two kinds of data given as a standard acceleration and a changed acceleration when the acceleration of the elevator is changed by the acceleration setting unit, and the assignment control unit assigns an appropriate elevator in consideration of the standard acceleration and the changed-acceleration.

(4) In the group management and control system for elevators of any one of above (1) to (3), preferably, the system further comprises an acceleration learning adjustment unit for adjustably setting, based on learning, limit values up to which the acceleration and the jerk rate of each elevator can be increased.

(5) In the group management and control system for elevators of above (4), preferably, the acceleration learning adjustment unit performs a test operation to confirm up to what levels of acceleration and jerk rate each elevator can travel with safety in a vacant state, and records results of the test operation for learning.

(6) In the group management and control system for elevators of above (5), preferably, the acceleration learning adjustment unit performs the test operation automatically when the elevator is out of service.

(7) In the group management and control system for elevators of any one of above (1) to (6), preferably, the system further comprises a user interface for optionally changing the acceleration, the jerk rate and operating conditions from the outside.

DESCRIPTION OF THE PREFERRED EMBODIMENT

Figure 1:
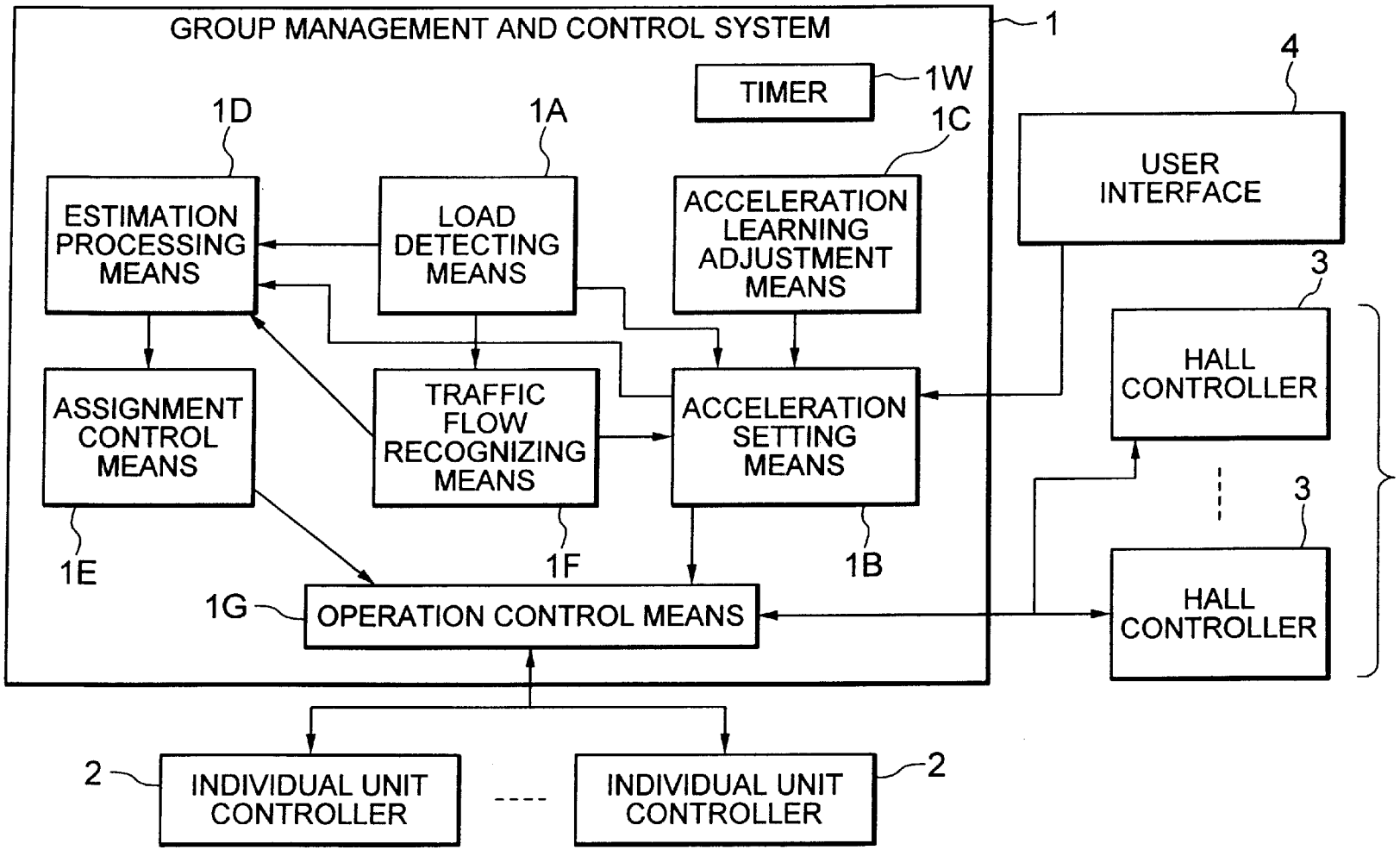
FIG. 1 is a block diagram showing a construction of a group management and control system for elevators according to one embodiment of the present invention.

A preferred embodiment of the present invention will be described below with reference to the drawings. FIG. 1 is a block diagram showing a construction of a group management and control system for elevators according to one embodiment of the present invention. Numeral 3 denotes a hall controller installed in each elevator hall to control a hall call button, a hall lantern, etc. When a person who is going to take an elevator (passenger) pushes the hall call button, a hall call is issued. The issued hall-call is inputted to a group management and control system 1 for implementation of group management and control. Also, in accordance with an instruction outputted from the group management and control system 1, each elevator cage is operated to travel, stop, and open/close a door under control of each individual unit controller 2. Further, the hall controller 3 preannounces to the passenger which elevator respond to the hall call.

The group management and control system 1 comprises a load detecting means 1A for detecting a load in each elevator cage; an acceleration setting means 1B for setting an acceleration and a jerk rate of each elevator to predetermined upper limit values in accordance with a detected result of the in-cage load from the load detecting means 1A when the in-cage load is within a certain range from a balanced state; an acceleration learning adjustment means 1C for adjustably setting, based on learning, limit values up to which the acceleration and the jerk rate of each elevator can be increased; a traffic flow recognizing means 1F for recognizing what traffic flow occurs in a building; an estimation processing means 1D for computing estimated time at which each elevator will arrive at each floor and an estimated in-cage load at each floor on the basis of the detected result of the in-cage load and the set acceleration and the recognized traffic flow; an assignment control means 1E for assigning an appropriate elevator in response to a call issued from an elevator hall in accordance with estimation processing results; an operation control means 1G for controlling operation of each elevator in accordance with an assignment result; and a timer 1W shared by those means for confirming the time, etc.

The group management and control system 1 further comprises a user interface 4 through which the user can change not only values of the acceleration and the jerk rate, but also conditions for performing the operation with the acceleration and the jerk rate having values different from ordinary ones.

Figure 2:
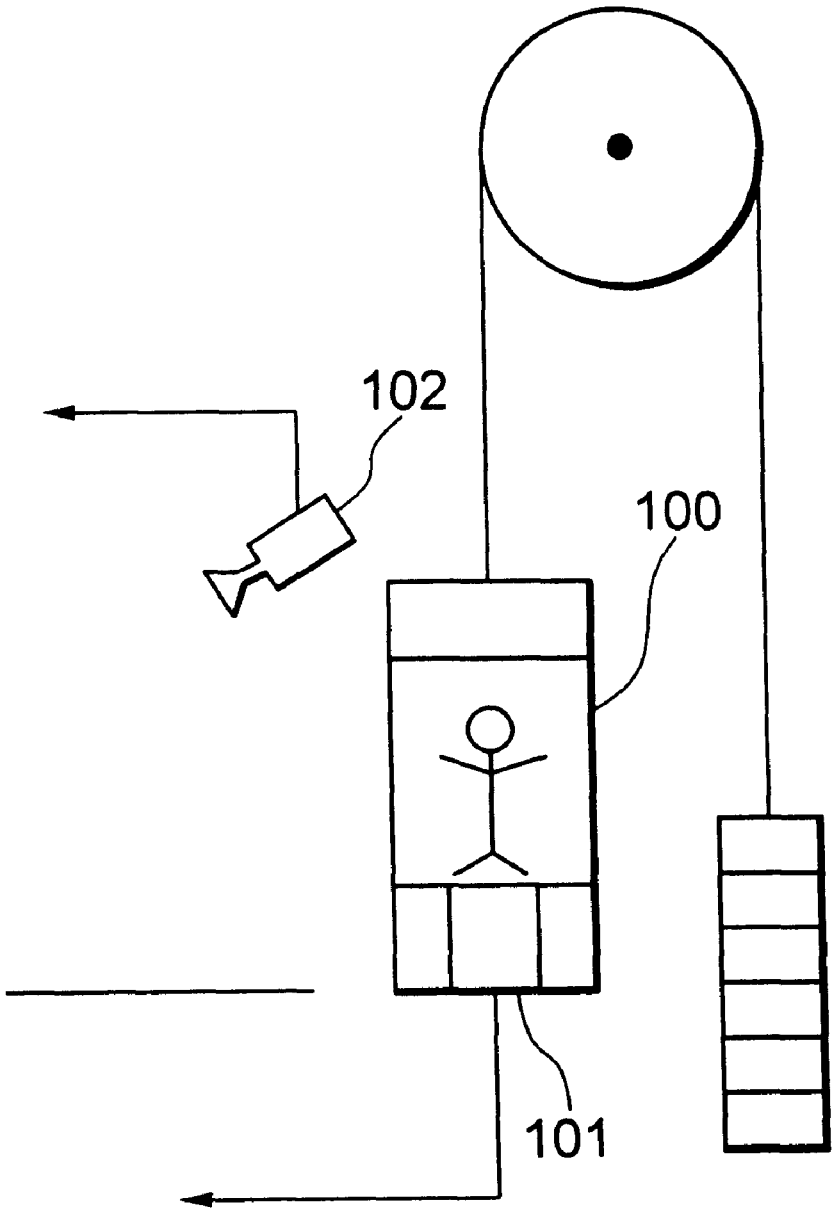
FIG. 2 is a schematic representation for explaining one example of load detecting means and traffic flow recognizing means in the present invention.

The load detecting means 1A is constructed, for example, by a load cell 101 provided under the floor of an elevator cage 100 shown in FIG. 2. The traffic flow recognizing means 1F recognizes the traffic flow in accordance with, for example, the frequency and magnitude of changes in output of the load cell 101, or information from a video camera 102 or the like provided at each floor.

Figure 3:
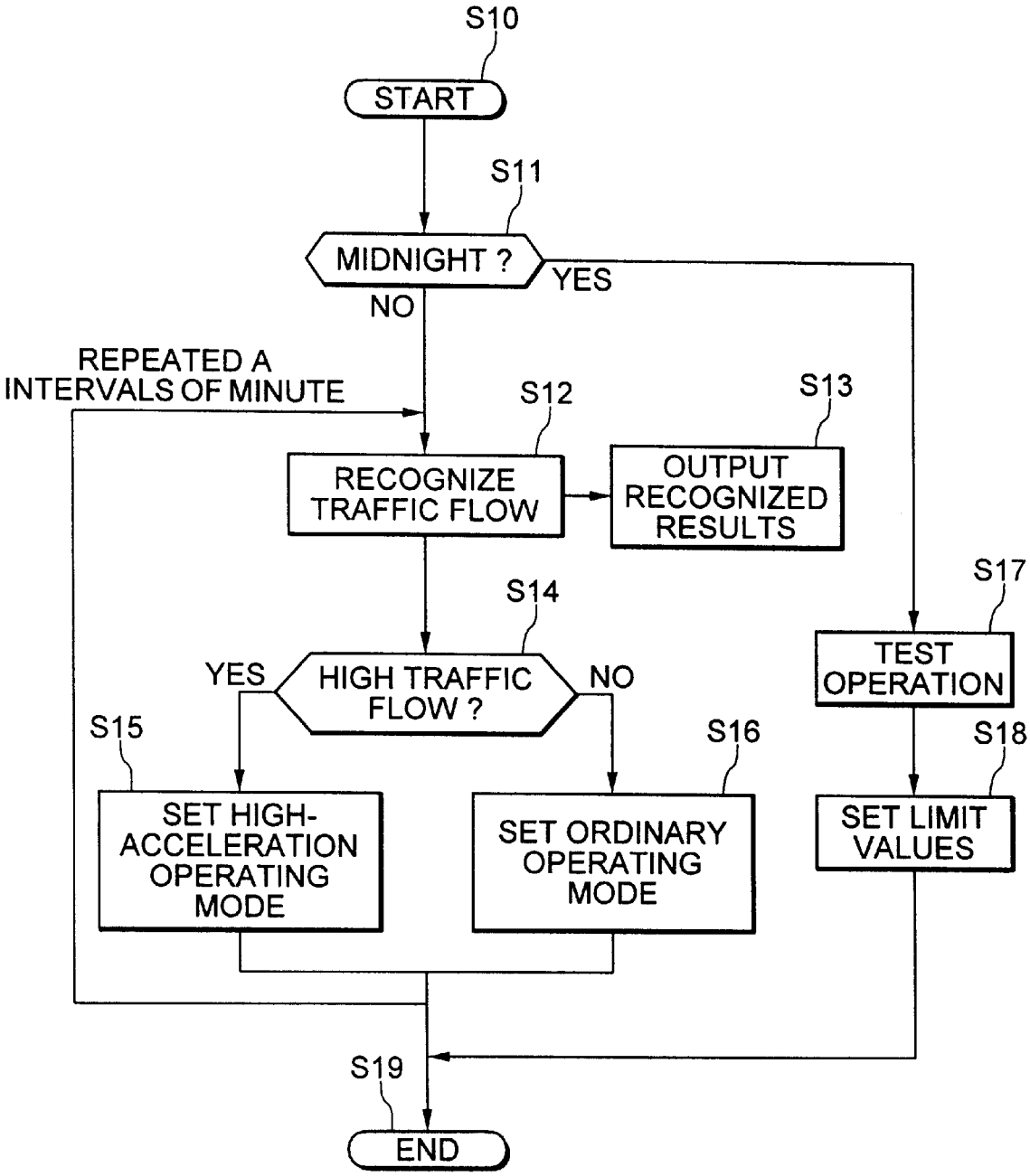
FIG. 3 is a flowchart showing an outline of condition setting procedures for allowing an elevator to travel at a high acceleration or jerk rate according to the present invention.

The operation will now be described with reference to FIG. 3 and the subsequent figures. FIG. 3 is a flowchart showing an outline of condition setting procedures for allowing an elevator to travel at a high acceleration or jerk rate as a part of the operation of the group management and control system according to the present invention.

First, step S11 determines whether it is midnight (or whether the elevator operation is out of service) in accordance with, e.g., an output of the timer 1W. If it is not midnight, the traffic flow recognizing means 1F recognizes the traffic flow in step S12 and then outputs recognized results in step S13. The recognized results include, for example, numerical values such as the number of passengers getting on and off the elevator at each floor, the total number of passengers and OD (origin and Destination) floors, as well as a pattern classification result representing that the current traffic is at, e.g., the up peak or down peak.

Next, step S14 determines whether the traffic flow is high at the up peak. If the traffic flow is high, the acceleration setting means 1B sets a high-acceleration operating mode in step S15. If the traffic flow is not high, the acceleration setting means 1B sets an ordinary operating mode in step S16. The above procedures from step S12 to S16 are periodically repeated at intervals of, e.g., one minute.

If it is determined to be midnight in step S1, the acceleration learning adjustment means 1C instructs each individual unit controller 2 in step S17 to perform a test operation. Then, in step S18, the acceleration learning adjustment means 1C records and learns up to what levels of acceleration and jerk rate each elevator can travel with safety in a vacant state, and sets limit values of the acceleration and jerk rate.

Whether the traffic flow is high at the up peak is determined in the above step S14 as a condition for setting the high-acceleration operating mode, but the condition to be determined is not limited to such an example. When full-cage passage or long wait is likely to occur at a particular floor, the high-acceleration operation may also be performed even in an ordinary traffic state to avoid such a problem. Further, whether to perform the high-acceleration operation or not may be determined in accordance with any suitable time period or other conditions set based on a desire of the user. The setting of the condition can be made with the user interface 4.

An outline of procedures for setting the acceleration and jerk rate of each elevator will now be described with reference to a flowchart of FIG. 4. After the passengers have finished getting on and off the elevator at each elevator hall in step S20, step S21 determines whether it is a time period in which the high-acceleration operating mode is to be set. This determination is made based on which one of the high-acceleration operating mode and the ordinary operating mode is set through a sequence of the steps shown in FIG. 3.

If the determination in step S21 is "Yes", the load detecting means 1A detects the in-cage load in step S22. Then, step S23 determines whether the in-cage load detected in step S22 is within a range allowing the high-acceleration operation. This determination is made, for example, using the following formula (1):

$$(50-X)\ \%<(\text{in-cage load})<(50+X)\ \% \qquad (1)$$

X %: threshold

Figure 5:
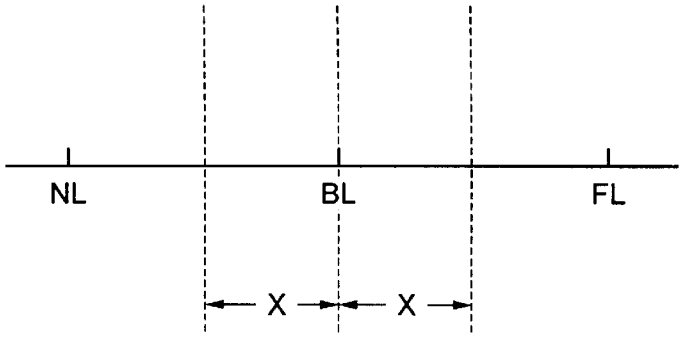
FIG. 5 is a schematic representation for explaining one example of an in-cage load allowable range in which the high-acceleration operation can be performed according to the present invention.

As illustrated in FIG. 5, the above formula represents that the in-cage load is within a certain range (±X) from a load balanced state (50%, BL in FIG. 5) (NL in FIG. 5 indicates a null load (vacant cage state) and FL indicates a full load state). In the above formula, the threshold X can be theoretically set based on specifications of hardware such as a hoist and a motor. Also, within the theoretical allowable range, the user can optionally set the threshold X using the user interface.

If the in-cage load is determined to be within the range allowing the high-acceleration operation (i.e., "Yes") in step S23, the acceleration and jerk rate of the elevator are set to higher values in step S24, and the elevator is started to travel in step S26. Those values are set to upper limit values within the theoretical allowable range. Also, those values are adjusted depending on the limit values set in step S18 of FIG. 3.

If the determination is "No" in step S21 or S23, the acceleration and jerk rate of the elevator are set to ordinary values in step S25, and the elevator is started to travel in step S26. In a sequence of the steps shown in FIG. 4, step S22 is executed by the load detecting means 1A, and the other steps are executed by the acceleration setting means 1B.

Figure 6:
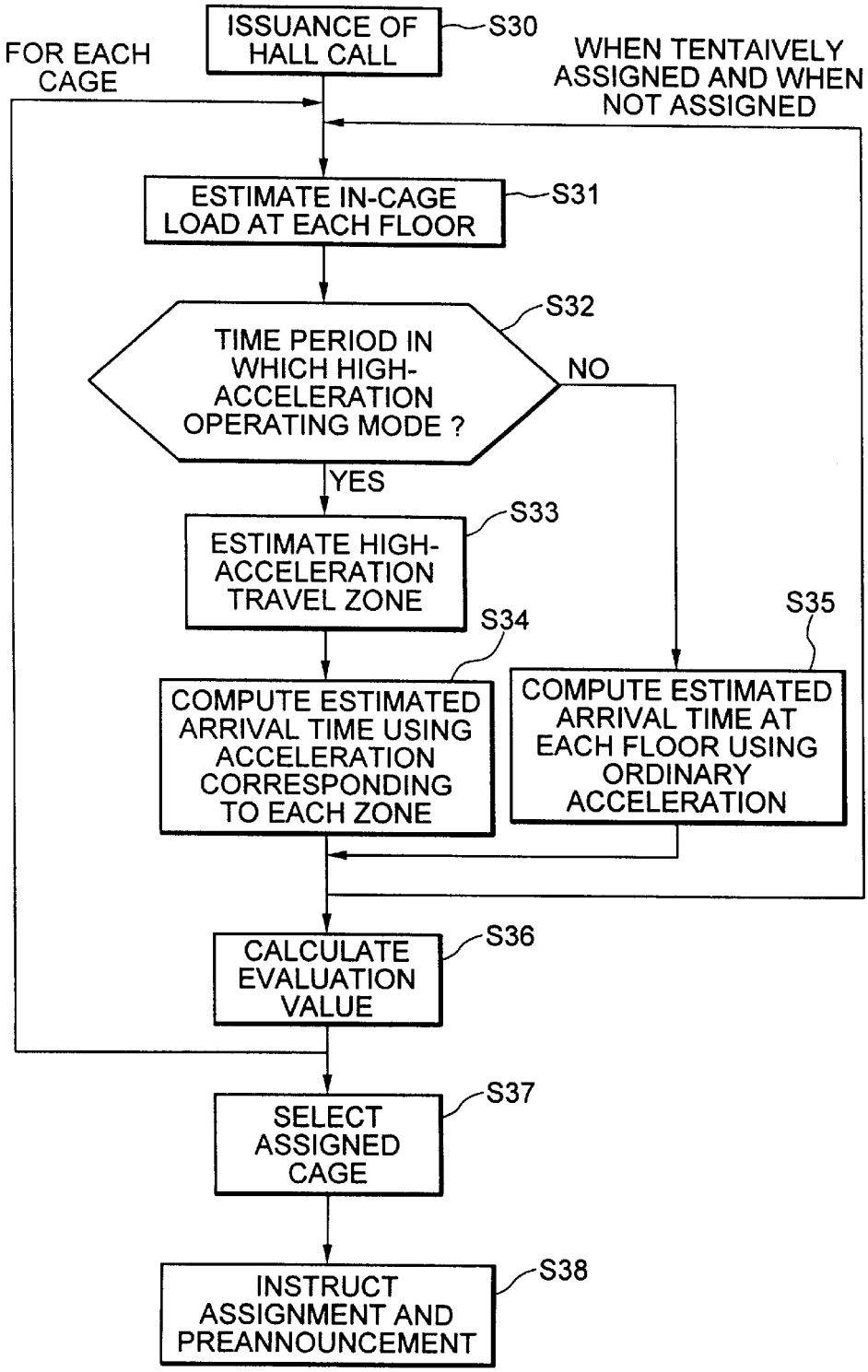
FIG. 6 is a flowchart showing an outline of procedures from generation of a hall call to selection of an elevator that is to make a response to the call according to the embodiment of the present invention.

An outline of procedures from generation of a hall call to selection of an elevator that is to make a response to the call will now be described with reference to a flowchart shown in FIG. 6. First, when a hall call is issued in step S30, step S31 estimates the number of persons who are going to get on and off the elevator at each floor thereafter and the in-cage load at the departure. This estimation is performed by utilizing the estimated results of the traffic flow in step S13 of FIG. 2.

Figure 4:
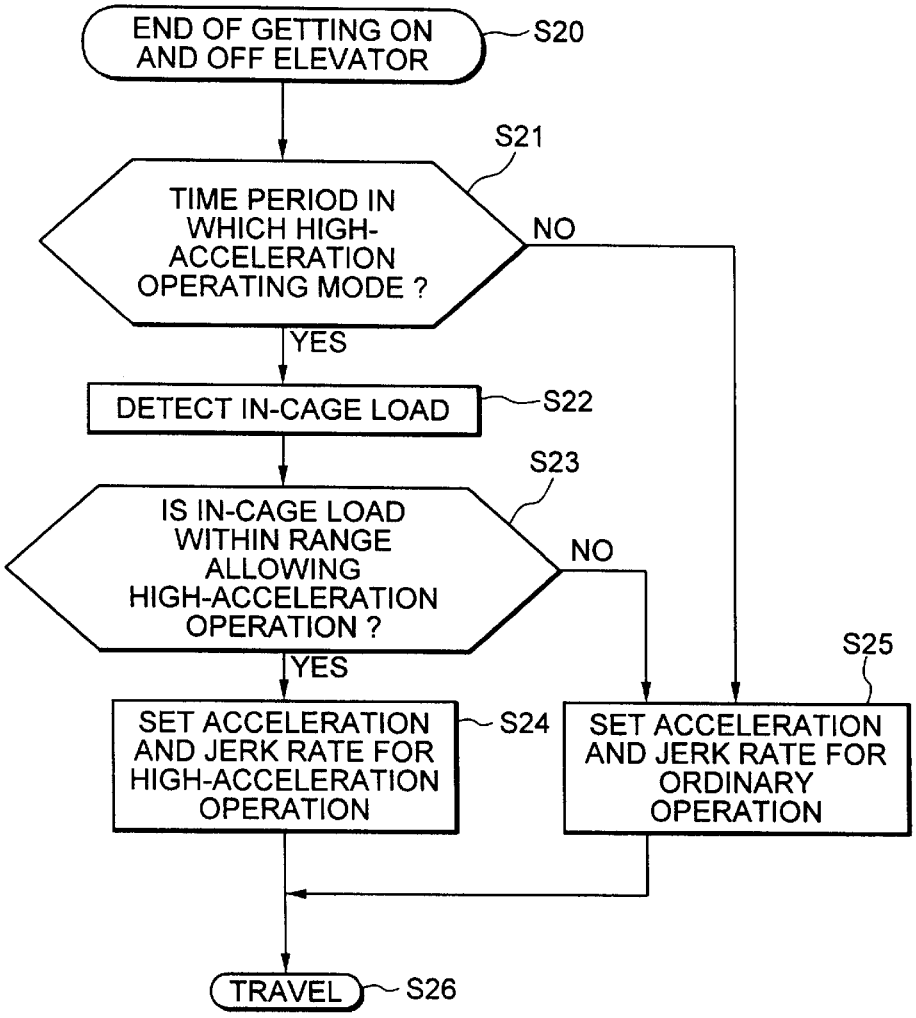
FIG. 4 is a flowchart showing an outline of procedures for setting the acceleration and jerk rate of each elevator according to the present invention.

Then, step S32 determines in a similar manner to step S21 of FIG. 4 whether it is a time period in which the high-acceleration operating mode is to be set. If the determination is "Yes" in step S32, a zone in which the elevator is to be traveled at a high acceleration and jerk rate and a zone in which the elevator is to be traveled ordinarily are estimated in step S33 on the basis of the estimated results in step S31.

On the basis of the estimated results, step S34 computes an estimated value of arrival time at each floor for the zone subjected to the high-acceleration operation by using the corresponding acceleration and jerk rate, and for the zone subjected to the ordinary operation by using the ordinary acceleration and jerk rate.

If the determination is "No" in step S32, step S35 computes an estimated value of arrival time at each floor by using the ordinary acceleration and jerk rate.

The above procedures from step S31 to S35 are executed for both cases where each elevator is tentatively assigned in response to the issued hall call and is not assigned.

Subsequently, on the basis of the above estimated results, step S36 computes evaluation indices such as a time during which the passengers must wait at each elevator hall, full-cage passage and wrong preannouncement, and then calculates an overall evaluation value for each elevator. The above procedures from step S31 to S36 are executed for all the elevators, i.e., for each cage.

After the overall evaluation value for each elevator has been calculated through a sequence of the above steps, the elevator having the best evaluation value is selected as an assigned cage in step S37, and an assignment instruction is issued and an preannouncement is made to the passengers waiting in the elevator hall in step S38.

Incidentally, the procedures from step S31 to S35 are executed by the estimation processing means 1D, and the procedures from step S36 to S38 are executed by the assignment control means 1F.

According to the present invention, as described above, in a group management and control system for elevators which manages and controls a plurality of elevators as a group, the system comprises the load detecting means for detecting a load in each elevator cage; the acceleration setting means for setting an acceleration and a jerk rate of each elevator to predetermined upper limit values in accordance with a detected result of the in-cage load from the load detecting means when the in-cage load is within a certain range from a balanced state; the estimation processing means for computing estimated time at which each elevator will arrive each floor on the basis of the detected result of the in-cage load and the set acceleration; the assignment control means for assigning an appropriate elevator in response to a call issued from an elevator hall in consideration of an estimation processing result; and the operation control means for controlling operation of each elevator in accordance with an assignment result. Therefore, the high-acceleration operation can be performed while an ordinary hoist, motor, etc. are employed and high transport efficiency can be realized without pushing up the cost.

Also, the system further comprises the traffic flow recognizing means for recognizing what traffic flow occurs in a facility in which the elevators are installed, and the estimation processing means computes the estimated time at which each elevator will arrive each floor and the estimated in-cage load at each floor on the basis of the detected result of the in-cage load, the set acceleration and the recognized traffic flow. Therefore, the arrival time and the in-cage load can be more precisely computed with estimation.

Further, the estimation processing means computes the estimated time at which each elevator will arrive each floor using two kinds of data given as a standard acceleration and a changed acceleration when the acceleration of the elevator is changed by the acceleration setting means, and the assignment control means assigns an appropriate elevator in consideration of the standard acceleration and the changed acceleration. Therefore, more precise estimation can be performed and a more appropriate elevator can be assigned.

Still further, the system further comprises an acceleration learning adjustment means for adjustably setting, based on learning, limit values up to which the acceleration and the jerk rate of each elevator can be increased. Therefore, even when the elevators travel at different accelerations from each other, satisfactory group management and control can be performed without causing wrong preannouncement.

Moreover, the acceleration learning adjustment means performs a test operation to confirm up to what levels of acceleration and jerk rate each elevator can travel with safety in a vacant state, and records results of the test operation for learning. Therefore, maximum transport efficiency can be always achieved within the safe range.

Furthermore, the acceleration learning adjustment means performs the test operation automatically when the elevator is out of service. Therefore, the test operation can be automatically made in a time period in which there are no passengers.

Additionally, the system further comprises a user interface for optionally changing the acceleration, the jerk rate and operating conditions from the outside. Therefore, each factor and condition can be externally set as desired.

What is claimed is:

1. A group management and control system for elevators which manages and controls a plurality of elevators as a group, said system comprising:

load detecting means for detecting a load in each of a plurality of elevator cages;

acceleration setting means for setting an acceleration and a jerk rate of each elevator cage to upper limit values in accordance with the load detected by said load detecting means when the load is within a certain range relative to a balanced state;

estimation processing means for computing an estimated time at which each elevator cage will arrive at each floor based on the load detected and the acceleration set;

assignment control means for assigning an elevator cage to respond to a call issued from an elevator hall in consideration of the estimated time; and operation control means for controlling operation of each elevator cage in accordance with assignment by said assignment control means.

2. The group management and control system for elevators according to claim 1, further comprising traffic flow recognizing means for recognizing what traffic flow occurs in a facility in which the elevators are installed, wherein said estimation processing means computes the estimated time at which each elevator cage will arrive at each floor and an estimated load at each floor based on the load detected, the acceleration set, and the traffic flow recognized.

3. The group management and control system for elevators according to claim 1, wherein said estimation processing means computes the estimated time at which each elevator will arrive at each floor using a standard acceleration and a changed acceleration when the acceleration of the elevator is changed by said acceleration setting means, and said assignment control means assigns an appropriate elevator cage in consideration of the standard acceleration and the changed acceleration.

4. The group management and control system for elevators according to claim 2, wherein said estimation processing means computes the estimated time at which each elevator will arrive at each floor using two a standard acceleration and a changed acceleration when the acceleration of the elevator is changed by said acceleration setting means, and said assignment control means assigns an appropriate elevator cage in consideration of the standard acceleration and the changed acceleration.

5. The group management and control system for elevators according to claim 1, further comprising acceleration learning adjustment means for adjustably setting, based on learning, limit values up to which the acceleration and the jerk rate of each elevator cage can be increased.

6. The group management and control system for elevators according to claim 2, further comprising acceleration learning adjustment means for adjustably setting, based on learning, limit values up to which the acceleration and the jerk rate of each elevator cage can be increased.

7. The group management and control system for elevators according to claim 3, further comprising acceleration learning adjustment means for adjustably setting, based on learning, limit values up to which the acceleration and the jerk rate of each elevator cage can be increased.

8. The group management and control system for elevators according to claim 4, further comprising acceleration learning adjustment means for adjustably setting, based on learning, limit values up to which the acceleration and the jerk rate of each elevator cage can be increased.

9. The group management and control system for elevators according to claim 5, wherein said acceleration learning adjustment means performs a test operation to confirm up to what levels of acceleration and jerk rate each elevator cage can travel with safety in a vacant state, and records results of the test operation for learning.

10. The group management and control system for elevators according to claim 6, wherein said acceleration learning adjustment means performs a test operation to confirm up to what levels of acceleration and jerk rate each elevator cage can travel with safety in a vacant state, and records results of the test operation for learning.

11. The group management and control system for elevators according to claim 7, wherein said acceleration learning adjustment means performs a test operation to confirm up to what levels of acceleration and jerk rate each elevator cage can travel with safety in a vacant state, and records results of the test operation for learning.

12. The group management and control system for elevators according to claim 8, wherein said acceleration learning adjustment means performs a test operation to confirm up to what levels of acceleration and jerk rate each elevator cage can travel with safety in a vacant state, and records results of the test operation for learning.

13. The group management and control system for elevators according to claim 9, wherein said acceleration learning adjustment means performs the test operation automatically when the elevator cage is out of service.

14. The group management and control system for elevators according to claim 10, wherein said acceleration learning adjustment means performs the test operation automatically when the elevator cage is out of service.

15. The group management and control system for elevators according to claim 11, wherein said acceleration learning adjustment means performs the test operation automatically when the elevator cage is out of service.

16. The group management and control system for elevators according to claim 12, wherein said acceleration learning adjustment means performs the test operation automatically when the elevator cage is out of service.

17. The group management and control system for elevators according to claim 1, further comprising a user interface for optionally changing the acceleration, the jerk rate, and operating conditions from outside.

18. The group management and control system for elevators according to claim 2, further comprising a user interface for optionally changing the acceleration, the jerk rate, and operating conditions from outside.

19. The group management and control system for elevators according to claim 3, further comprising a user interface for optionally changing the acceleration, the jerk rate, and operating conditions from outside.

20. The group management and control system for elevators according to claim 5, further comprising a user interface for optionally changing the acceleration, the jerk rate, and operating conditions from outside.

* * * * *